US008528971B2

(12) United States Patent
Bilodeau et al.

(10) Patent No.: US 8,528,971 B2
(45) Date of Patent: Sep. 10, 2013

(54) SEATING SPACERS FOR SEATING SYSTEMS

(75) Inventors: Ron G. Bilodeau, Arundel, ME (US); Carl J. Sukeforth, Somerville, MA (US); Kerry Briggs, North Berwick, ME (US); Erik Cloutier, Waterboro, ME (US)

(73) Assignee: Hussey Seating Company, North Berwick, ME (US)

( * ) Notice: Subject to any disclaimer, the term of this patent is extended or adjusted under 35 U.S.C. 154(b) by 0 days.

(21) Appl. No.: 12/397,059

(22) Filed: Mar. 3, 2009

(65) Prior Publication Data

US 2009/0224579 A1 Sep. 10, 2009

Related U.S. Application Data

(60) Provisional application No. 61/068,031, filed on Mar. 4, 2008.

(51) Int. Cl.
*A47C 15/00* (2006.01)
*A47C 7/00* (2006.01)

(52) U.S. Cl.
USPC ..... 297/248; 297/440.14

(58) Field of Classification Search
USPC ..... 297/248, 249, 180.2, 217.7, 440.14, 297/188.14, 463.1
See application file for complete search history.

(56) References Cited

U.S. PATENT DOCUMENTS

| | | | | | |
|---|---|---|---|---|---|
| 3,347,593 | A * | 10/1967 | Walkinshaw | ..... | 297/248 |
| 3,494,662 | A * | 2/1970 | Anderson et al. | ..... | 297/248 |
| 3,702,204 | A * | 11/1972 | Tipton | ..... | 297/248 |
| 4,438,603 | A * | 3/1984 | Durkan, Jr. | ..... | 52/8 |
| 4,490,949 | A | 1/1985 | Sutter et al. | | |
| 4,790,594 | A * | 12/1988 | Temos | ..... | 297/248 |
| 5,897,163 | A * | 4/1999 | Singer | ..... | 297/217.7 |
| 5,957,530 | A * | 9/1999 | Gutgsell | ..... | 297/248 |
| 6,733,082 | B1 * | 5/2004 | Treon | ..... | 297/440.22 |
| 7,150,442 | B2 * | 12/2006 | Kleckner | ..... | 248/429 |
| 7,810,882 | B2 * | 10/2010 | Bartlmae et al. | ..... | 297/248 |
| 2006/0108844 | A1 * | 5/2006 | Suprina | ..... | 297/217.7 |

* cited by examiner

*Primary Examiner* — Sarah B McPartlin
(74) *Attorney, Agent, or Firm* — Preti Flaherty Beliveau & Pachios LLP

(57) ABSTRACT

A seating spacer configured to fit between two seating units in a seating system bench-type seating. In one embodiment, at least one seating spacer is placed between two seating units arranged in a side-by-side manner to form a row of seating in a seating system.

16 Claims, 4 Drawing Sheets

SEATING SPACERS FOR SEATING SYSTEMS

CROSS REFERENCES TO RELATED APPLICATIONS

This application claims the benefit of U.S. Provisional Application No. 61/068,031, filed Mar. 4, 2008.

BACKGROUND OF THE INVENTION

The use of seating systems for arenas, auditoriums, gymnasiums, and other venues is well known. Such seating systems can include both telescopic and fixed systems. Telescopic seating systems have multiple rows of seating affixed to moveable segments commonly referred to as platforms. In use, a telescopic seating system may be extended from the wall of the facility to provide a full seating capacity. When not in use, the telescopic seating system may be folded back against the wall with each telescopic platform, in turn, being positioned under the platform located directly above so that all platforms are stacked in compact arrangement just in front of the wall, thereby providing additional usable floor space. Fixed seating systems comprise multiple rows of seating mounted to tiered, stationary platforms.

Bench-type seating is commonly used in both telescopic and fixed seating systems. Traditional bench-type seating configurations utilize long rows of metal or wooden planks affixed to the platforms. More recently, bench-type seating configurations have employed individual molded plastic seating units arranged in a row as an alternative to the traditional metal or wooden planking. Such seating units are generally designed to accommodate a single person and are attached to the underlying platform adjacent to each other to form a continuous row of seating. The molded units typically have a compound curved shape for improved comfort. While these seating units are generally made of a width designed to accommodate an average person (an 18-inch seat width is the industry standard), many users can still experience a lack of personal space, particularly insufficient hip, elbow and shoulder room.

DETAILED DESCRIPTION OF THE INVENTION

Figure 2:
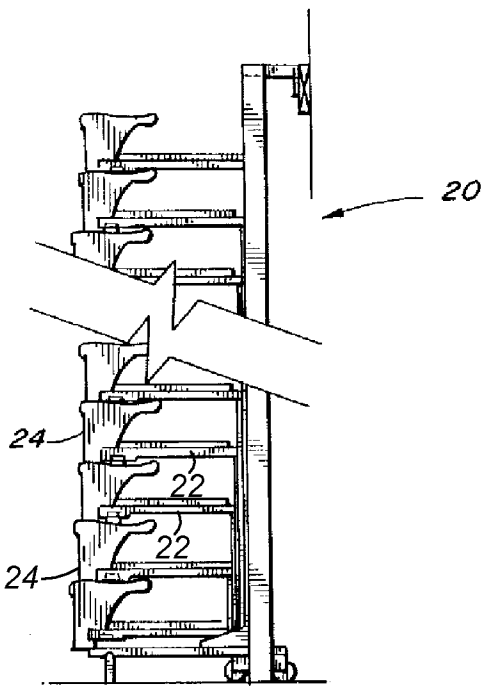
FIG. 2 is a side view of the seating system in its storage or retracted state.
Figure 1:
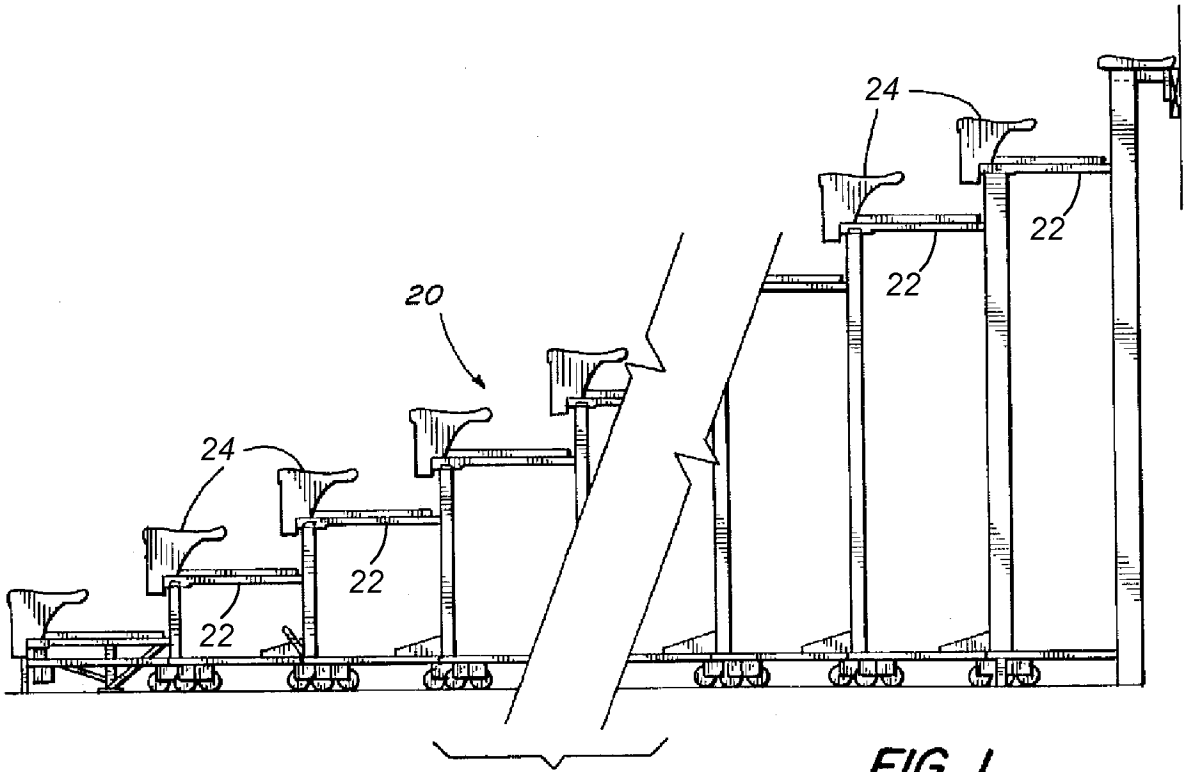
FIG. 1 is a side view of one embodiment of a seating system, having bench-type seating, in its operational or extended state.

Referring to the drawings wherein identical reference numerals denote the same elements throughout the various views, FIGS. 1 and 2 show an exemplary embodiment of a seating system 20 having bench-type seating. Although the seating system 20 of the illustrated embodiment is a telescopic seating system, it should be noted that this is for purposes of illustration only and the present invention is applicable to all types of seating systems including fixed systems. The telescopic seating system 20 includes a number of tiered platforms 22 supported by suitable understructure. The understructure is provided for movably supporting the seating system 20 on the floor, and the platforms 22 cooperate such that each can slide in relation to its adjacent platforms so that the seating system 20 may move between an extended or operational state shown in FIG. 1 and a retracted or storage state shown in FIG. 2. Movement of the seat system 20 may be accomplished either manually or by a powered means.

Each platform 22 supports a row of seating mounted on the upper surface thereof, with each row comprising a number of individual seating units or seats 24. In general, each seat 24 is molded from extremely tough, strong, durable, and inert polymeric thermoplastic or a similar material. Such material can be made in a wide variety of attractive colors and can be given any desired texture, such as a simulated grain surface. It is stain resistant, impervious to moisture, and easily cleaned. Such material is also scratch and dent resistant and resistant to impacts. The upper surface of each seat 24 is contoured for the comfort of the seat occupant. The seats 24 are attached at nose or front edge of the respective platform 22 using any suitable fastening system, which typically includes bolts and mounting brackets.

Figure 3:
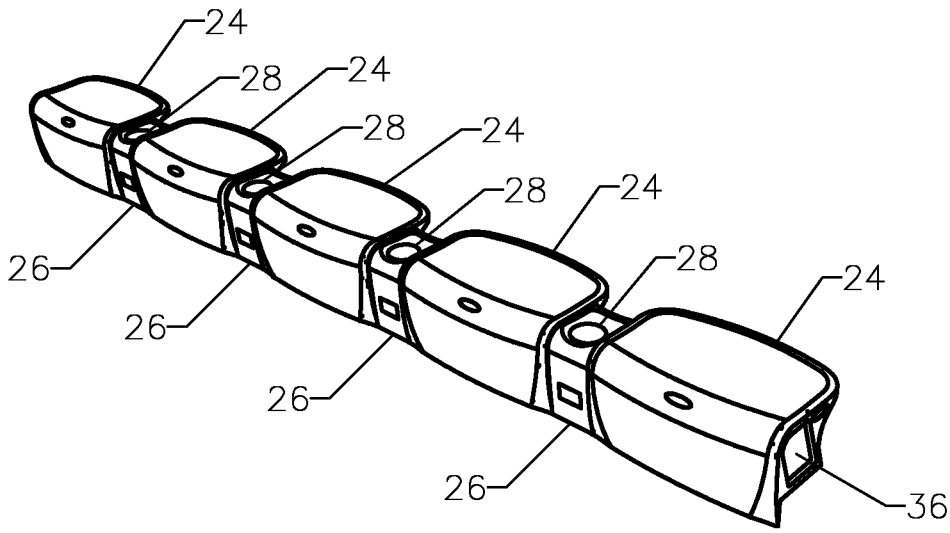
FIG. 3 is a perspective view of a row of seats for a seating system having bench-type seating.
Figure 4:
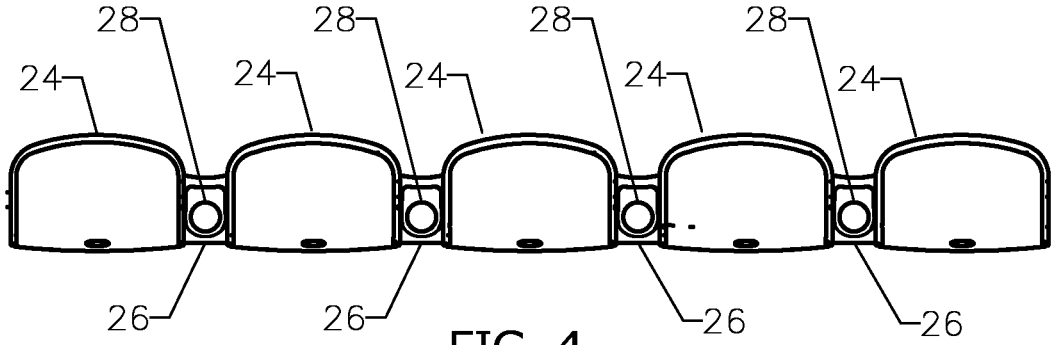
FIG. 4 is a top view of the row of seats of FIG. 3.
Figure 5:
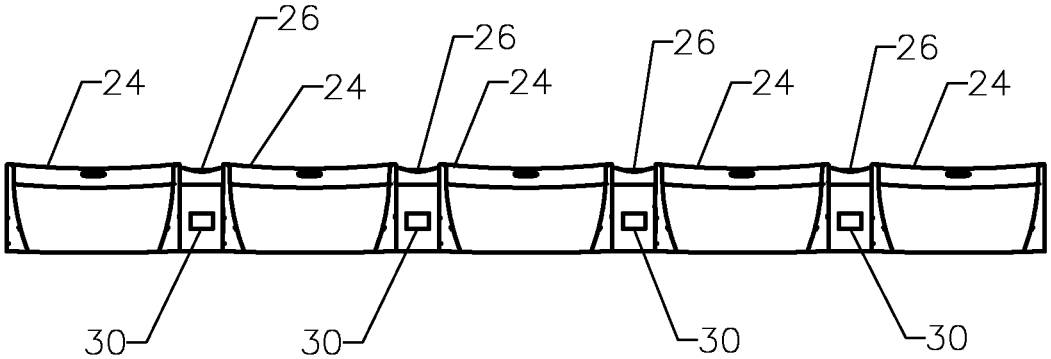
FIG. 5 is an elevation view of the row of seats of FIG. 3.

FIGS. 3-5 show a row of seats 24 as attached to a single platform 22 (not shown in FIGS. 3-5). It is noted that the row of seats 24 could be mounted to a platform in a telescoping or fixed seating system. The seats 24 are arranged in a substantially side-by-side manner, with a seating spacer 26 placed between each set of adjacent seats 24. The seating spacers 26 are configured to fit between two seats 24 and increase comfort by providing seat occupants more personal space, specifically more hip, elbow and shoulder room. In this example, the row comprises five seats 24 and four spacers 26. However, this is just for purposes of illustration and it should be understood that the present invention could encompass any number of seats and an appropriate number of spacers.

Each seating spacer 26 comprises a substantially block-shaped body that includes a front wall, a rear wall, a top wall and two side walls. The side walls are configured to closely engage a corresponding side of the adjacent seats 24. The seating spacers 26 are thus positioned flush with the adjacent seats 24 (as shown in FIGS. 3-5) such that the seats 24 and the seating spacers 26 form a contiguous assembly without significant gaps between the seats 24 and the seating spacers 26.

The seating spacers 26 can be made of an injection molded plastic material such as polypropylene or polyethylene. In the illustrated embodiment, the seating spacers 26 have a cup holder 28 formed in the upper surface thereof. The spacers 26 can include other amenities, such as an integral caddy tray for holding small items, instead of, or in addition to, the cup holders 28. A marker 30 (FIG. 5) can be affixed to the front surface of the seating spacers 26. The marker 30 can be a donor plate or an advertising panel that can generate revenue for the owner or operator of the venue. The front surface of each seating spacer 26 can have a shallow recess formed therein to receive the marker 30. Furthermore, a marker or the like could be affixed to the top and/or side surfaces of the spacers 26 instead of, or in addition to, the marker 30 affixed to the front surface.

While the seating spacers 26 can be used in all rows of the seating system 20, it is possible to provide spacers 26 only in limited sections of the seating system 20 (such as the first four rows by way of example) to create luxury or "VIP" seating sections. Furthermore, the rows of seats and spacers can be used with folding backrests.

The seating spacers 26 can be any suitable width, which will typically but not necessarily be in the range of about 2-5 inches. Even larger widths, such as 6 or 9 inches, are also possible. In one embodiment, the width of the spacers 26 will be a simple fraction (i.e., a fraction having whole numbers for the numerator and the denominator) of the width of the seats 24. By way of example, the illustrated embodiment shows the width of the spacers 26 as being equal to one-fourth of the seat width. Therefore, the space occupied by four spacers 26 is equal to the width of one seat 24. This gives a certain amount of flexibility in setting up a seating arrangement because a row having five seats 24 and four spacers 26 and a row having six seats 24 with no spacers would have the same overall length. The height of each seating spacer 26 is substantially equal to the height of the seats 24. That is, the spacer height will typically be the same or only slightly less than the seat height.

Figure 6:
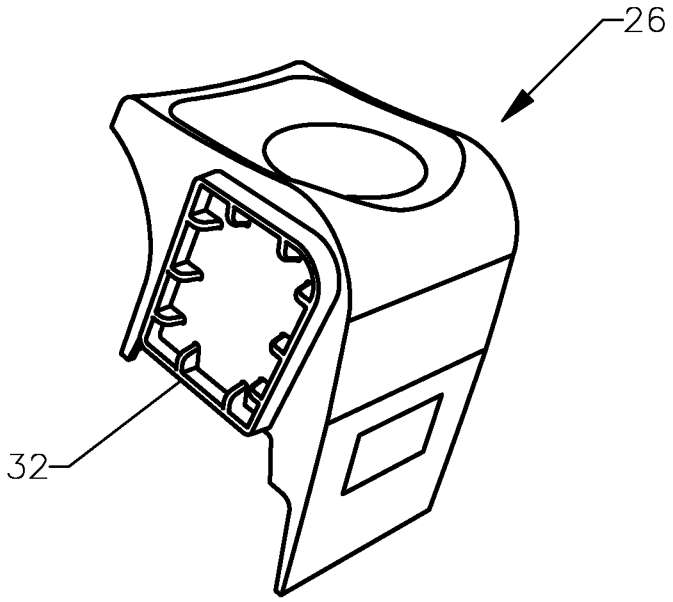
FIG. 6 is a perspective view of one embodiment of a seating spacer.
Figure 7:
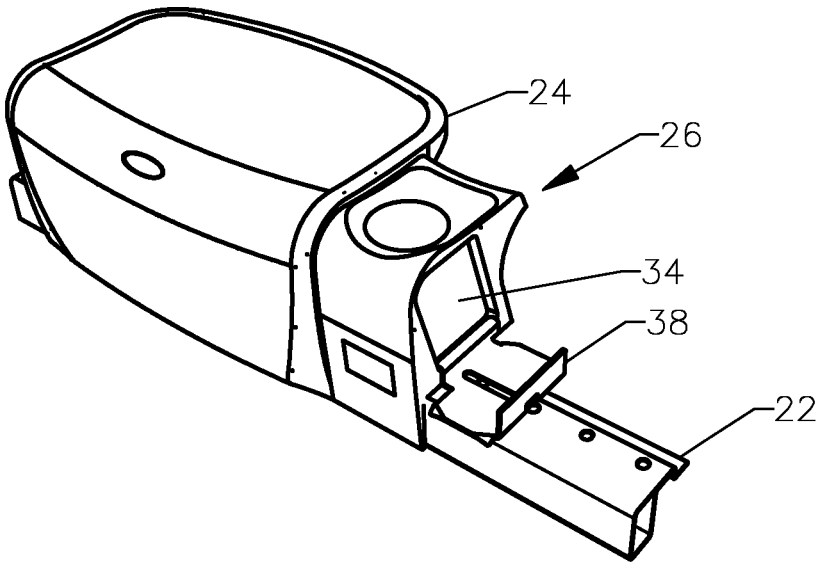
FIG. 7 is another perspective view of the seating spacer of FIG. 6 showing its attachment to the platform of a seating system.

Referring now to FIGS. 6 and 7, one possible embodiment of a seating spacer 26 is shown in more detail. Each spacer 26 typically comprises a single-piece, molded structure or body having integral interlocks adapted for interlocking engagement with the seats 24 adjacent each side of the spacer 26. In the illustrated embodiment, the left side wall of the spacer 26 has a projection 32 formed thereon and the right side wall has a recess 34 formed therein. Similarly, each seat 24 has a conforming projection (not shown) formed on its left side wall and a conforming recess 36 (one shown in FIG. 3) formed in its right side wall. Thus, when a spacer 26 is arranged in side-by-side abutting relation between two seats 24, the projection 32 on the left side of the spacer 26 is received in the corresponding recess of the seat 24 to the left of the spacer 26, and the recess 34 on the right side of the spacer 26 receives the corresponding projection on the seat 24 to the right of the spacer 26. This interlocking engagement can function to retain the seating spacer 26 in the seating system 20. As seen in FIG. 7, the spacer 26 is mounted to the leading edge of a platform 22 via brackets 38 that are bolted to the platform 22, thereby providing additional, or alternative, means for retaining the seating spacer 26 in the seating system 20.

Figure 8:
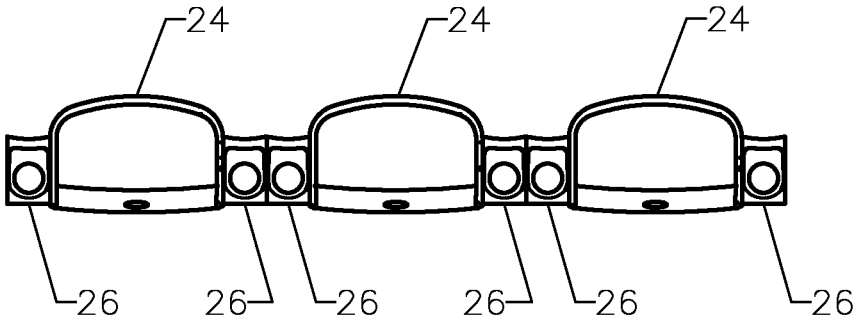
FIG. 8 is a top view of another embodiment of a row of seats for a seating system having bench-type seating.

It is also possible to have multiple seating spacers 26 between a pair of seats 24. For example, FIG. 8 shows two seating spacers 26 between each pair of seats 24, although more than two seating spacers would also be possible. FIG. 8 further shows that it possible to include a seating spacer 26 at the end of a row of seats 24 (i.e., not having a seat on each side of the spacer).

What is claimed is:

1. A seating spacer configured to fit between two seating units in a seating system having bench-type seating in which a plurality of said seating units are arrayed along and mounted to a laterally-extending platform, each of said seating units having a top wall, mutually parallel side walls, and a front wall intermediate the respective side walls, the seating unit front walls and side walls having substantially equal heights, said seating spacer comprising:

a substantially block-shaped body having opposed, spaced-apart seating spacer front and rear walls, opposed, spaced-apart seating spacer first and second side walls, and a seating spacer top wall adjoining the seating spacer front wall, rear wall, and side walls, wherein substantially all of said seating spacer first side wall is configured to abut a seating unit side wall of an adjacent first one of said seating units and wherein substantially all of said seating spacer second side wall is configured to abut a seating unit side wall of an adjacent second one of said seating units, wherein said seating spacer first side wall has a substantially rectangular projection formed thereon and configured to be resiliently received in a complimentary substantially rectangular recess formed in the abutting seating unit side wall of the adjacent first one of said seating units, wherein said seating spacer second side wall has a substantially rectangular recess formed therein and configured to resiliently receive a complimentary substantially rectangular projection formed on the abutting seating unit side wall of the adjacent second one of said seating units, and wherein said seating spacer front wall defines a height that is substantially equal to the front wall and side wall heights of the seating units between which the seating spacer is configured to fit.

2. The seating spacer of claim 1 further comprising a cup holder formed in said seating spacer top wall.

3. The seating spacer of claim 1 further comprising a marker affixed to a front surface defined by said front wall of said substantially block-shaped body.

4. The seating spacer of claim 1 wherein said seating spacer comprises a single-piece molded body made from a molded plastic material.

5. The seating spacer of claim 1 in combination with a bracket configured for engaging said seating spacer and connecting said seating spacer to said platform of said seating system.

6. A row of seating for a seating system, said row of seating comprising:

first and second seating units mounted to a laterally-extending platform; and the seating spacer of claim 1 arranged in a side-by-side abutting relation between said first and second seating units.

7. The row of seating of claim 6 wherein said seating spacer is positioned flush to said first and second seating units such that said first and second seating units and said seating spacer form a contiguous assembly.

8. The row of seating of claim 6 wherein said first seating unit defines a first width, said second seating unit defines a second width, and said seating spacer defines a width that is less than at least one of said first and second widths.

9. The row of seating of claim 8 wherein said first and second widths are equal.

10. The row of seating of claim 9 wherein the width of said seating spacer is a mathematical factor and non-trivial divisor of each of said first and second widths.

11. The row of seating of claim 8 wherein the width of said seating spacer is about 2-5 inches.

12. The row of seating of claim 6 further comprising another seating spacer placed between said first and second seating units.

13. The row of seating of claim 6 wherein said seating spacer is made from a molded plastic material.

14. A row of seating for a seating system, the row of seating comprising:

a laterally-extending platform;

first and second seating units arrayed along and mounted to the platform, each of said seating units having a top wall, mutually parallel side walls, and a front wall intermediate the respective side walls, the seating unit front walls and side walls having substantially equal heights; and a seating spacer disposed between the first and second seating units, wherein the seating spacer comprises a substantially block-shaped body having opposed spaced-apart front and rear walls, opposed spaced-apart first and second side walls, and a seating spacer top wall adjoining the seating spacer front wall, the rear wall, and the side walls, wherein substantially all of the seating spacer first side wall abuts a side wall of the first seating unit and substantially all of the seating spacer second side wall abuts a side wall of the second seating unit, such that the first and second seating units and the seating spacer define a contiguous assembly without significant gaps between the seating units and the seating spacer, wherein the seating spacer first side wall has a substantially rectangular projection formed thereon and is resiliently received in a complimentary substantially rectangular recess formed in the abutting seating unit side wall of the adjacent first seating unit, wherein the seating spacer second side wall has a substantially rectangular recess formed therein and resiliently receives a complimentary substantially rectangular projection formed on the abutting seating unit side wall of the second seating unit, and wherein the seating spacer front wall defines a height that is substantially equal to the front wall and side wall heights of the first and second seating units.

15. The row of seating of claim 14 wherein the seating spacer includes a cup holder formed in an upper surface defined by the top wall of the substantially block-shaped body.

16. The row of seating of claim 14 wherein the seating spacer includes a marker affixed to a front surface defined by the front wall of the substantially block-shaped body.

* * * * *